US011103121B1

(12) United States Patent
Wood

(10) Patent No.: US 11,103,121 B1
(45) Date of Patent: Aug. 31, 2021

(54) FOLDABLE DISH DRYING RACK WITH REMOVABLE UTENSIL HOLDER

(71) Applicant: Zak Wood, Santa Monica, CA (US)

(72) Inventor: Zak Wood, Santa Monica, CA (US)

( * ) Notice: Subject to any disclaimer, the term of this patent is extended or adjusted under 35 U.S.C. 154(b) by 0 days.

(21) Appl. No.: 16/999,950

(22) Filed: Aug. 21, 2020

(51) Int. Cl.
*A47L 19/04* (2006.01)

(52) U.S. Cl.
CPC ..... *A47L 19/04* (2013.01)

(58) Field of Classification Search
CPC ..... A47L 19/02; A47L 19/04
See application file for complete search history.

(56) References Cited

U.S. PATENT DOCUMENTS

| | | | | | |
|---|---|---|---|---|---|
| 253,461 | A * | 2/1882 | Wold | A47L 19/04 | 211/41.6 |
| 946,977 | A * | 1/1910 | Muller | A47L 19/04 | 211/41.6 |
| 1,835,232 | A * | 12/1931 | Lord | A47L 19/02 | 211/85 |
| D252,251 | S | 7/1979 | Lundahl | | |
| 4,212,400 | A * | 7/1980 | Buchsteiner | A47L 19/04 | 211/41.6 |
| 4,221,299 | A * | 9/1980 | Taylor | A47L 19/04 | 211/41.6 |
| D271,339 | S * | 11/1983 | Lee | D32/55 | |
| D322,343 | S | 12/1991 | Pearcy | | |
| 6,038,784 | A * | 3/2000 | Dunn | A47L 19/04 | 211/41.6 |
| D423,160 | S | 4/2000 | Lenney | | |
| D429,863 | S | 8/2000 | Lenney | | |
| 6,516,956 | B2 * | 2/2003 | Martorella | A47L 19/04 | 211/41.5 |
| D473,359 | S | 4/2003 | Joseph | | |
| 8,573,410 | B2 | 11/2013 | Chalifoux | | |
| 8,925,742 | B1 * | 1/2015 | Chitayat | A47L 19/04 | 211/41.6 |
| D732,256 | S * | 6/2015 | Huang | D32/55 | |
| 9,107,552 | B2 * | 8/2015 | Micek | A47L 19/04 | |
| 9,730,571 | B1 * | 8/2017 | Lee | A47L 19/04 | |
| D858,021 | S | 8/2019 | Li | | |
| 10,631,711 | B2 * | 4/2020 | Dunn | A47L 19/04 | |
| 10,674,890 | B1 * | 6/2020 | Armstrong | A47L 19/04 | |
| 2001/0047968 | A1 | 12/2001 | Wright | | |
| 2005/0145583 | A1 * | 7/2005 | Martorella | A47L 19/04 | 211/41.6 |

(Continued)

FOREIGN PATENT DOCUMENTS

| | | | | |
|---|---|---|---|---|
| CH | 188281 | A * | 12/1936 | A47L 19/04 |
| CH | 203391 | A * | 3/1939 | A47L 19/04 |
| CH | 711085 | A2 * | 11/2016 | A47L 19/04 |

(Continued)

*Primary Examiner* — Stanton L Krycinski

(57) ABSTRACT

A foldable dish drying rack has a rack base section, a rack back section pivotally connected to the rack base section and a rack upright section pivotally connected to the rack base section rearward of the rack back section. The rack upright section supports the rack back section in an unfolded condition. A removable utensil tray has utensil tray support arms with utensil tray support arm notches that accept a top edge of base side members to support the utensil tray on either side of the rack base section when the dish drying rack is in the unfolded condition.

20 Claims, 12 Drawing Sheets

(56) References Cited

U.S. PATENT DOCUMENTS

| | | | | |
|---|---|---|---|---|
| 2008/0149644 | A1* | 6/2008 | Piacenza | A47L 19/04<br>220/572 |
| 2008/0283480 | A1 | 11/2008 | Segal et al. | |

FOREIGN PATENT DOCUMENTS

| | | | | | |
|---|---|---|---|---|---|
| DE | 706307 | C | * | 5/1941 | A47L 19/04 |
| FR | 644534 | A | * | 10/1928 | A47L 19/04 |
| FR | 811983 | A | * | 4/1937 | A47L 19/04 |
| FR | 2898481 | A1 | * | 9/2007 | A47L 19/04 |
| GB | 225430 | A | * | 12/1924 | A47L 19/04 |
| GB | 627197 | A | * | 8/1949 | A47L 19/04 |

* cited by examiner

FOLDABLE DISH DRYING RACK WITH REMOVABLE UTENSIL HOLDER

RELATED APPLICATIONS

This is the first application filed for this invention.

FIELD OF THE INVENTION

This invention relates in general to racks for drying dishes and utensils, and, in particular to a novel foldable dish dying rack with a removable utensil holder.

FIELD OF THE INVENTION

Racks for drying dishes and utensils are well known and commercially available in a variety of shapes, sizes and configurations. However, most commercially available dish drying racks are made of plastic or metal. While plastic is convenient in the short term, it deteriorates over time and the production as well as the disposal of the used article are costly for the environment. Metal racks generally last longer and are more easily recycled, however the production of metal racks is costly for the environment and metal racks can rust and/or leave scratch marks or unsightly stains on some ceramics.

There therefore exists a need for a dish rack made of a sustainable material that is easily recycled, will not scratch or stain dishes, and is foldable for easy storage when not in use. There also exist a need for a foldable dish rack with a removable utensil holder that promotes the rapid drying of utensils.

SUMMARY OF THE INVENTION

It is an object of the invention to provide a dish rack made of a sustainable material that is foldable for easy storage when not in use. It is a further object of the invention to provide a foldable dish rack with a removable utensil holder that promotes the drying of utensils.

The invention therefore provides a foldable dish drying rack comprising: a substantially rectangular rack base section having a plurality of base slats; a substantially rectangular rack back section pivotally connected to the rack base section, the rack back section having a plurality of back slats that respectively lie in a same plane as the respective base slats, the rack back section being pivotable from a folded condition in which the rack back section lies flat on the rack base section to an unfolded condition; and a substantially rectangular rack upright section pivotally connected to the base side members behind the back side members, the rack upright section being pivotable from a folded condition in which the rack upright section lies flat on the rack base section and the rack back section to the unfolded condition in which the rack upright section supports a top of the rack back section, the rack upright section having a plurality of spaced-apart upright posts that extend above a top of the rack back section in the unfolded condition.

The invention further provides a foldable dish drying rack comprising: a rack base section having two parallel base side members affixed to at least two base cross members and a plurality of identical base slats equally spaced-apart between the base side members and affixed to the base cross members; a rack back section having two parallel back side members having bottom ends that are respectively pivotally connected to one of the base side members, the back side members being affixed to back cross members, and a plurality of identical back slats affixed to the back cross members between the back side members and parallel therewith, each back slat lying in a same plane as a corresponding base slat; and a rack upright section having two parallel upright side members with bottom ends that are respectively pivotally connected to the base side members behind the back side members, the upright side members being affixed to upright cross members, and a plurality of upright posts affixed to a rear side of the upright cross members between the base side members and in parallel therewith.

The invention yet further provides a foldable dish drying rack comprising: a rack base section having two parallel base side members affixed to a top of opposed ends of three base cross members and a plurality of identical base slats equally spaced-apart between the base side members and affixed to each of the base cross members; a rack back section having two parallel back side members having bottom ends that are respectively pivotally connected to one of the base side members, the back side members being affixed to opposed ends of two back cross members, and a plurality of identical back slats affixed to each of the back cross members between the back side members and parallel therewith, each back slat lying in a same plane as a corresponding base slat; a rack upright section having two parallel upright side members with bottom ends that are respectively pivotally connected to the base side members behind the back side member pivots, the upright side members being affixed to a front side of opposed ends of two upright cross members, and a plurality of upright posts affixed to a rear side of the upright cross members between the base side members and in parallel therewith; and a utensil tray connectable to one of the base side members of the rack base section, the utensil tray having utensil tray side panels, a utensil tray center panel, a utensil tray bottom panel and utensil tray slats connected to the utensil tray side panels and the utensil tray center panel, and further having utensil tray support arms connected to outer side edges of the respective utensil tray side panels, the utensil tray support arms having utensil tray support arm notches that accept a top edge of one of the base side members to support the utensil tray in an upright condition.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a foldable dish drying rack made of a sustainable material. The dish rack folds flat for easy storage and includes a removable utensil holder designed to rapidly drain utensils and promote air drying thereof. The removable utensil tray can be attached to either side of the unfolded dish rack. The dish drying rack has a base section and a back section, each having a plurality of spaced-apart slats that provide three-dimensional slots to receive and support plates of various sizes in an on-edge orientation, or bowls and the like in an inverted orientation for rapid draining and air drying. The dish rack further includes an upright section that supports the back section, the upright section including spaced-apart vertical posts for supporting cups, glasses, bottles or bags in an inverted orientation to facilitate air drying.

Parts List

Figure 1:
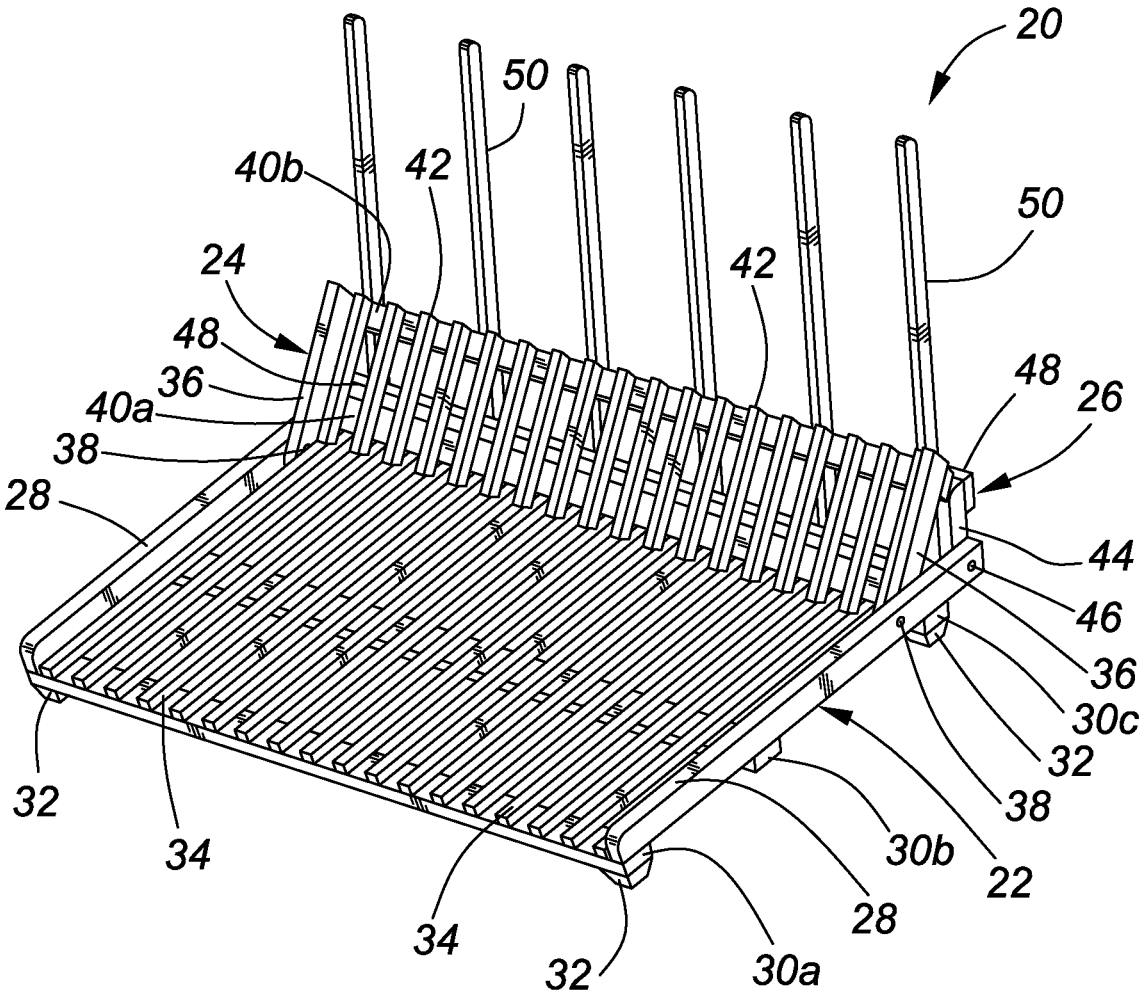
FIG. 1 is a perspective view of a foldable dish drying rack in accordance with the invention, shown in an unfolded condition.

20 Dish drying rack
22 Rack base section
24 Rack back section
26 Rack upright section
28 Base side members
30*a-c* Base cross members
32 Base feet
34 Base slats
36 Back side members
38 Back side member pivots
40*a-b* Back cross members
42 Back slats
44 Upright side members
46 Upright side member pivots
48 Upright cross members
50 Upright posts
52 Upright post reinforcement member
54 Utensil tray
56 Utensil tray side panels
58 Utensil tray center panel
60 Utensil tray bottom panel
62 Utensil tray slats
64 Utensil tray support arms
66 Utensil tray support arm notches FIG. 1 is a perspective view of the foldable dish drying rack 20 shown in an unfolded condition. In one embodiment the dish drying rack 20 is made of bamboo, though any suitable renewable, stain-resistant wood species such as maple, oak, basswood or the like may be used. All fasteners used to assemble the dish drying rack 20 are made from a corrosion resistant metal such as stainless steel, and all adhesives used during assembly of the dish drying rack 20 are non-toxic and waterproof when cured. In one embodiment a food-grade oil product is applied to provide a protective and preservative finish on the dish drying rack 20.

The dish drying rack 20 has a rack base section 22, a rack back section 24 and a rack upright section 26. In one embodiment, the rack base section 22 is substantially rectangular and about 40 cm×29 cm (16"×11.4"). The rack base section 22 includes two base side members 28 of equal length. The two base side members 28 are affixed to opposed ends of spaced-apart base cross members 30. In one embodiment there are three base cross members 30*a*-30*c*. A base foot 32 is affixed to opposed ends of the front base cross member 30*a* and opposed ends of the rear base cross member 30*c*. In one embodiment the four base feet 32 are made of a slip-resistant silicone or rubber product. Affixed to a top surface of each base cross member 30*a*-30*c* between the base side members 28 are a plurality of equally spaced-apart base slats 34 that are respectively parallel with the base side members 28. In one embodiment, the base slats 34 are substantially square and measure about 7.88 mm (0.31") per side. In one embodiment, there is a space of about 13.125 mm (0.517") between adjacent side surfaces of the respective base slats 34.

The rack back section 24 is substantially rectangular and includes two parallel back side members 36 of equal length. The back side members 36 are affixed to back cross members 40. In one embodiment there are two back cross members 40*a*, 40*b*, better seen in FIG. 2, and the back cross members 40*a*, 40*b* are affixed to a rear edge of the respective back side members 36. In one embodiment, a top edge of back cross member 40*a* is 80 mm (3.15") below a top edge of back cross member 40*b*. A bottom end of each of the back side members 36 is pivotally attached to the base side members 28 by back side member pivots 38. The rack back section 24 further includes a plurality of equally spaced-apart back slats 42 affixed to a top surface of the respective back cross members 40. The number of back slats 42 is equal to the number of base slats 34 and they have the same nominal cross-sectional dimensions. In one embodiment, the back slats 42 are 110 mm (4.33") in length and a top end of each back slat 42 is flush with a top edge of the back cross member 40*b*. Furthermore, each back slat 42 is aligned with a corresponding base slat 34, as also best seen in FIG. 2. The back cross member 40*b* contacts a rounded top corner of upright side members 44 to support the rack back section 24 in the unfolded condition, as better seen in FIG. 4.

Figure 3:
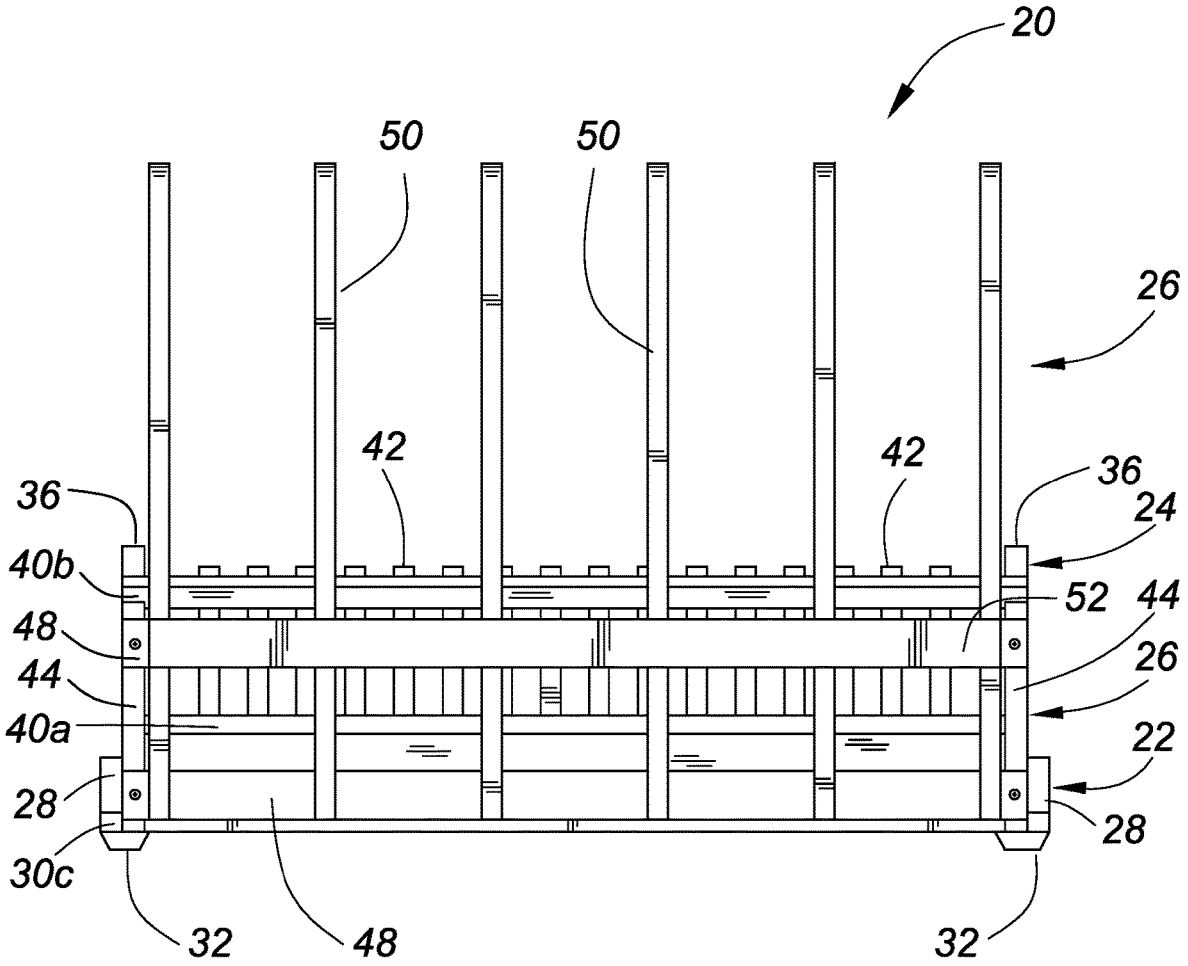
FIG. 3 is a rear elevational view of the dish drying rack in the unfolded condition.

The rack upright section 26 includes two upright side members 44 of equal length, best seen in FIG. 3. The respective upright side members 44 are pivotally attached to the base side members 28 by upright side member pivots 46 (only one of which can be seen in this perspective view) rearward of the back side member pivots 38. The respective upright side members 44 are affixed to front surfaces of two upright cross members 48, also best seen in FIG. 3. A plurality of upright posts 50 are affixed to a rear surface of the respective upright cross members 48. In one embodiment, the rack upright section 26 includes six upright posts 50 with the same nominal cross-sectional dimensions as those of the base slats 34 and the back slats 42. In one embodiment, each upright post 50 is about 27 cm long. The outermost upright posts 50 are respectively aligned with the outermost base slats 34 and back slats 42, and the upright posts 50 are equally spaced-apart.

Figure 2:
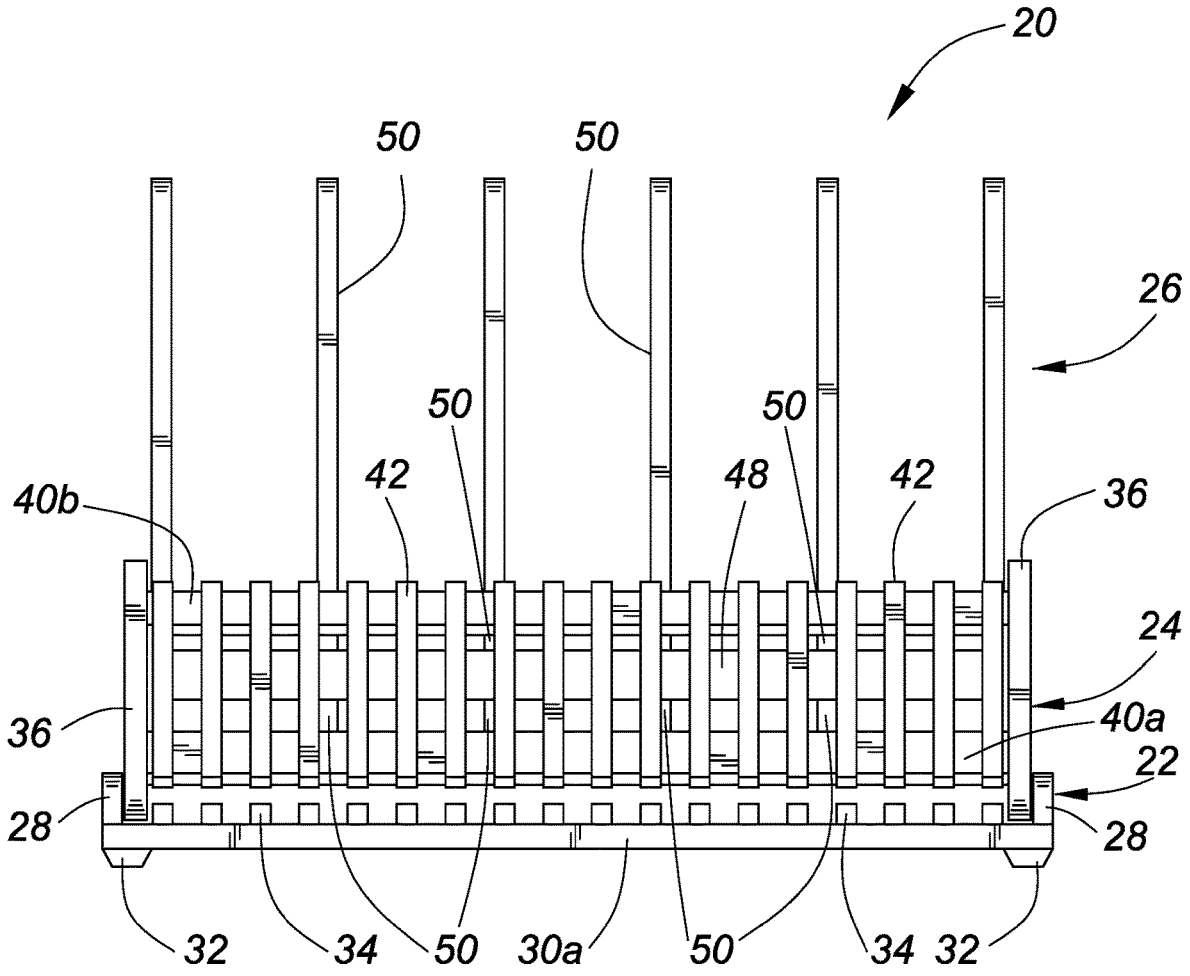
FIG. 2 is a front elevational view of the dish drying rack in the unfolded condition.

FIG. 2 is a front elevational view of the foldable dish drying rack 20 in the unfolded condition. As explained above, each base slat 34 is aligned with a corresponding back slat 42. The space between each adjacent pair of base slats 34 and corresponding back slats 42 defines a three-dimensional slot when the dish drying rack 20 is in the unfolded condition. The three-dimensional slot receives an edge of a plate of substantially any useful dimension and supports the plate in an on-edge orientation for rapid draining and air drying, as explained in more detail with reference to FIG. 19.

FIG. 3 is a rear elevational view of the dish drying rack 20 in the unfolded condition. In one embodiment the rack upright section 26 includes an upright post reinforcement member 52 that is aligned with a top one of the upright cross members 48 and is affixed to each upright post 50. The upright post reinforcement member 52 extends from an outer edge of the respective outermost upright posts 50 on each side of the rack upright section 26, as also seen in FIG. 5.

Figure 4:
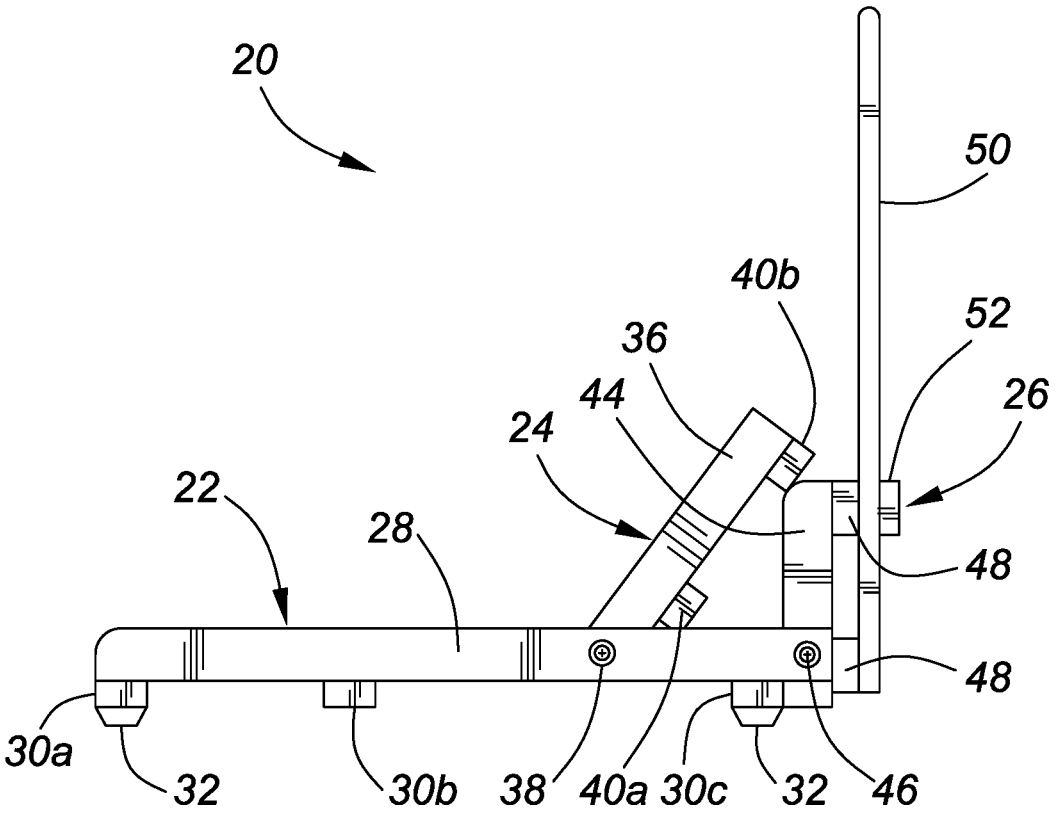
FIG. 4 is a side elevational view of the dish drying rack in the unfolded condition.
Figure 19:
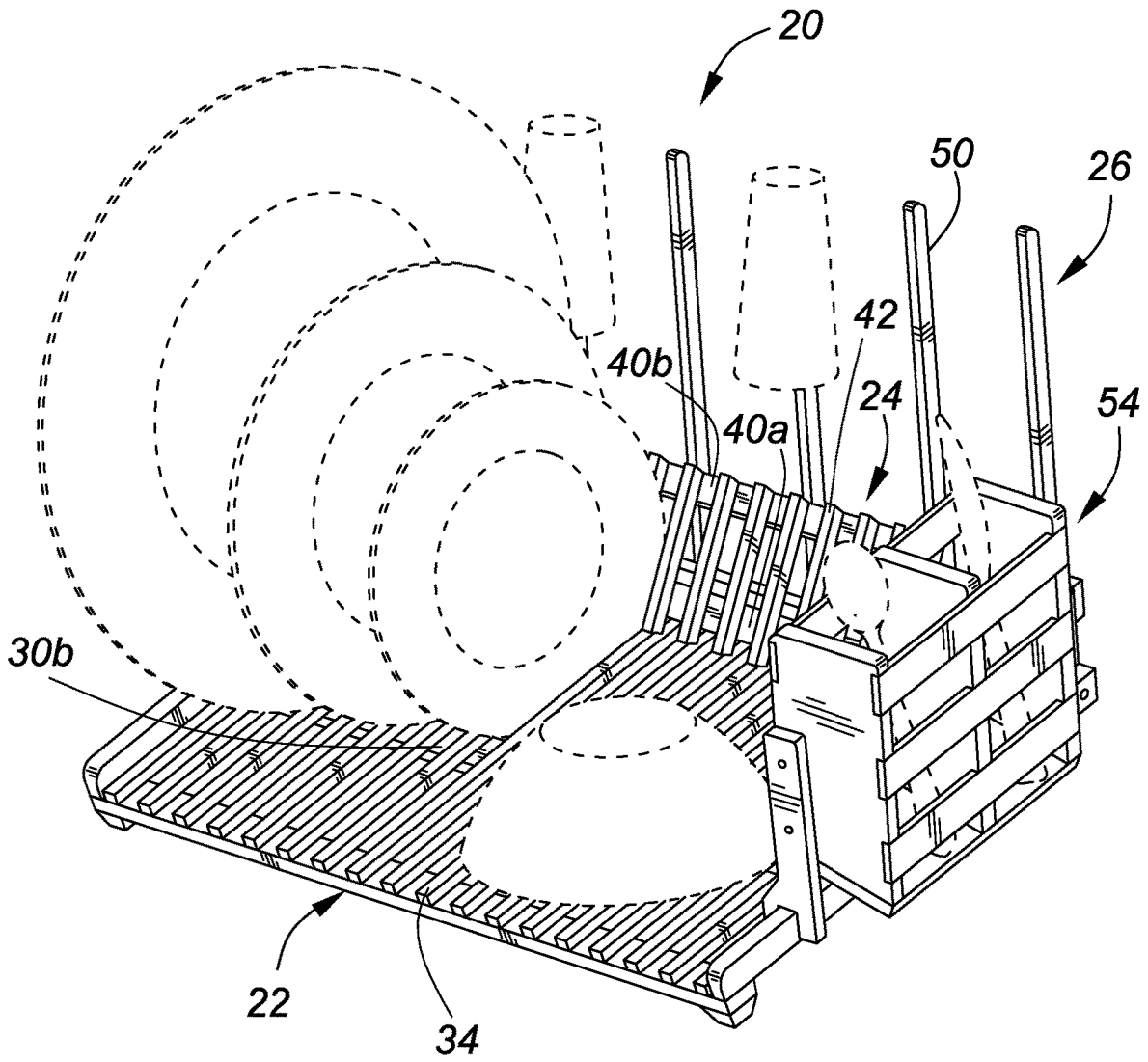
FIG. 19 is a perspective view of the dish drying rack with the removable utensil tray in an exemplary use condition.

FIG. 4 is a side elevational view of the dish drying rack 20 in the unfolded condition. As explained above, each upright side member 44 has a rounded front top corner. The back cross member 40*b* rests against the rounded top corner of the respective upright side members 44 when the dish drying rack 20 is in the unfolded condition. In the unfolded condition the rack back section 24 is at an angle of about 120° with respect to the rack base section 22 to optimize a range of plates that can be supported by the dish drying rack 20, as will be explained below in more detail with reference to FIG. 19. As well, the bottom ends of the upright side members 44 rest against the base cross member 30*c* when the dish drying rack 20 is in the unfolded condition to maintain the upright posts 50 in a vertical orientation for supporting glasses, cups, bags or the like as shown in FIG. 19. In this view the back side member pivots 38 and the upright side member pivots 46 are clearly visible. In one embodiment, the upright side member pivots 46 are spaced about 1 cm (0.39") from a rear end of the base side members 28, and the back side member pivots 38 are spaced about 8 cm (3.15") forward of the upright side member pivots 46, i.e. about 9 cm (3.54") from the rear end of the respective base side members 28. In one embodiment, all base side members 28, base cross members 30*a-b*, back side members 36, back cross members 40*a-b*, upright side members 44 and upright cross members 48 have the same nominal cross-sectional dimensions of 10 mm×20 mm (0.39"×0.78") and are laminated from two 5 mm×20 mm pieces for dimensional stability.

Figure 5:
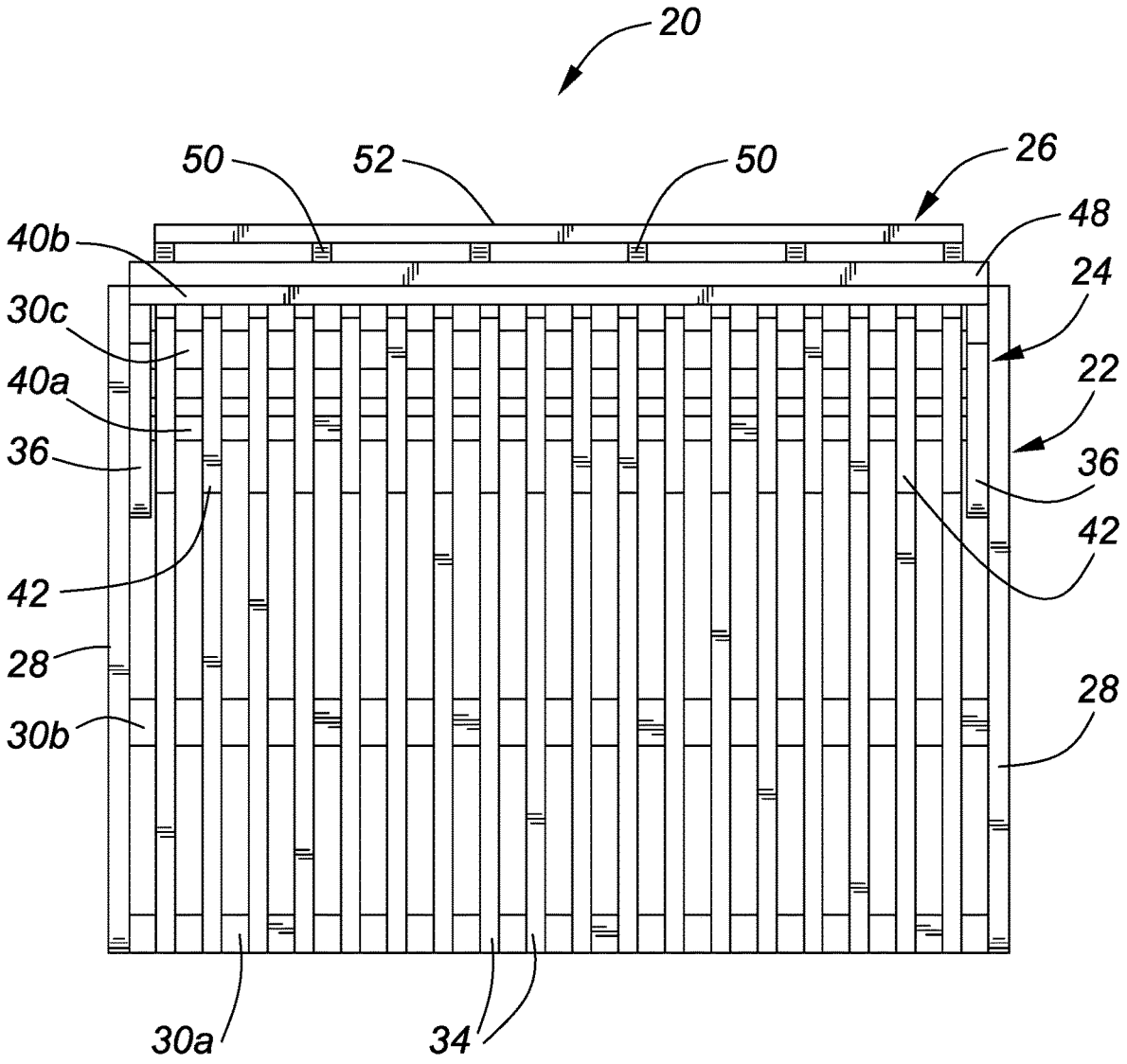
FIG. 5 is a top plan view the of the dish drying rack in the unfolded condition.

FIG. 5 is a top plan view of the dish drying rack 20 in the unfolded condition. As explained above, in one embodiment the outermost upright posts 50 are aligned with the outermost base slats 34 and the outermost back slats 42.

Figure 6:
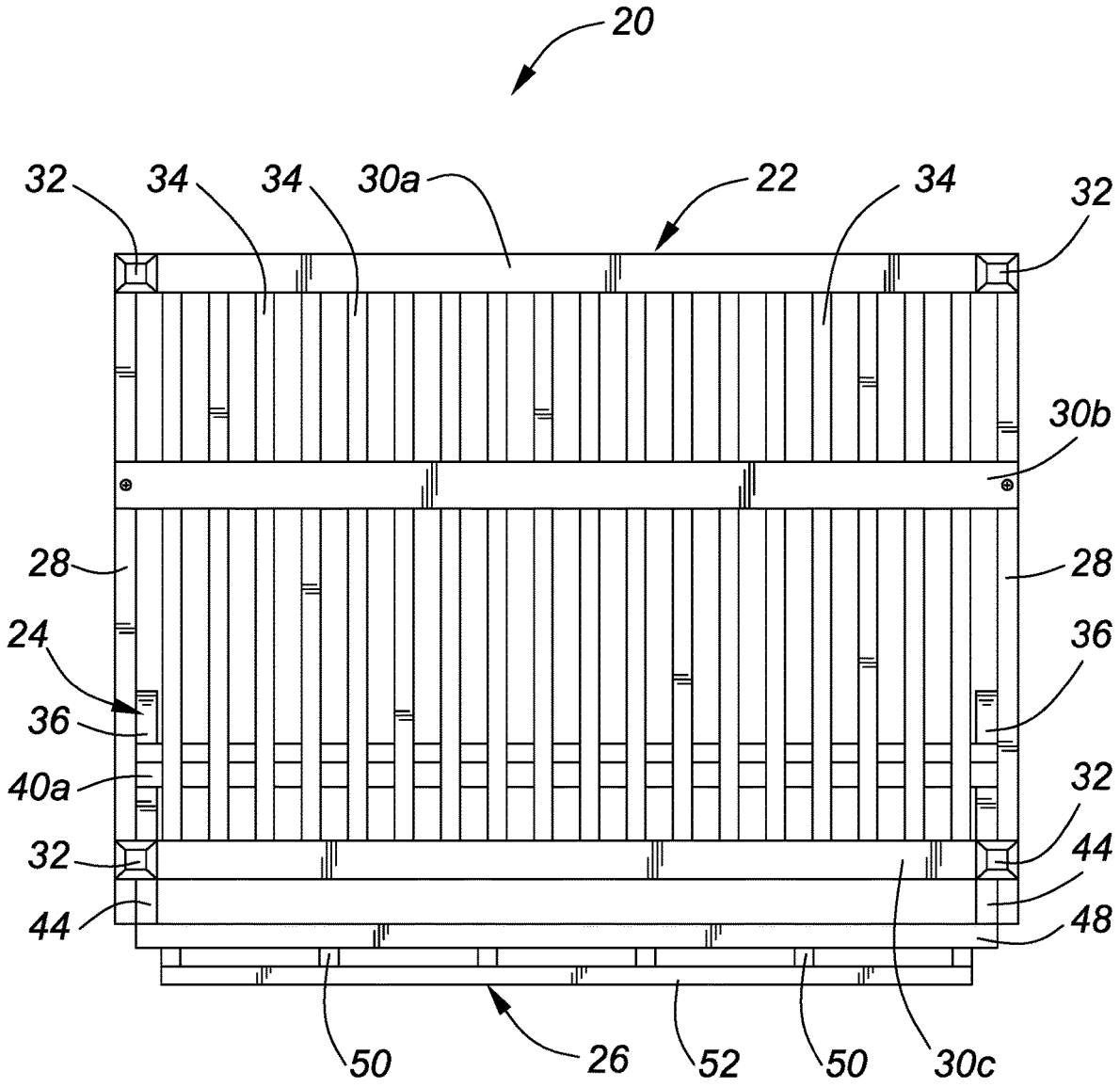
FIG. 6 is a bottom plan view of the dish drying rack in the unfolded condition.

FIG. 6 is a bottom plan view of the dish drying rack 20 in the unfolded condition. As can be seen, the base cross member 30*b* is affixed to the base side members 28 and the base slats 34 nearer the base cross member 30*a* than the base cross member 30*c*. In one embodiment, a front edge of the base cross member 30*b* is about 9 cm (3.54") from a front end of the base side members 28, and a rear edge of the base cross member 30*c* is about 2 cm (0.79") from a rear end of the base side members 28.

Figure 7:
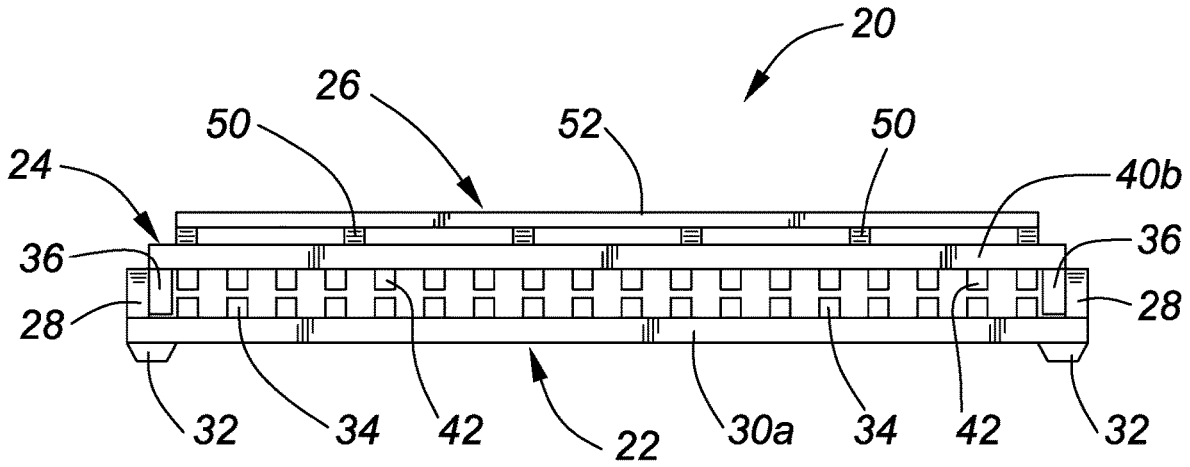
FIG. 7 is a front elevational view of the dish drying rack in a folded condition.

FIG. 7 is a front elevational view of the dish drying rack 20 in a folded condition. As can be seen, in the folded condition, the rack back section 24 is pivoted forward on back side member pivots 38 and the back side members 36 rest on the base cross member 30*b* (see FIG. 9).

Figure 8:
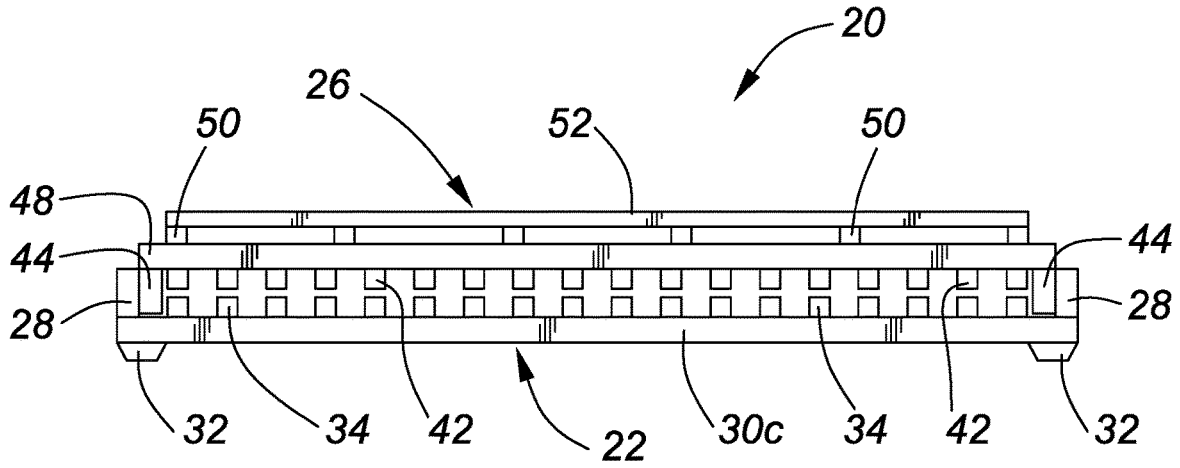
FIG. 8 is a rear elevational view of the dish drying rack in the folded condition.

FIG. 8 is a rear elevational view of the dish drying rack 20 in the folded condition. As can be readily appreciated in this view, each pair of base slats 34 and back slats 42 lie in the same plane, and the outermost upright posts 50 lie in the same plane as the outermost base slats 34 and back slats 42.

Figure 9:
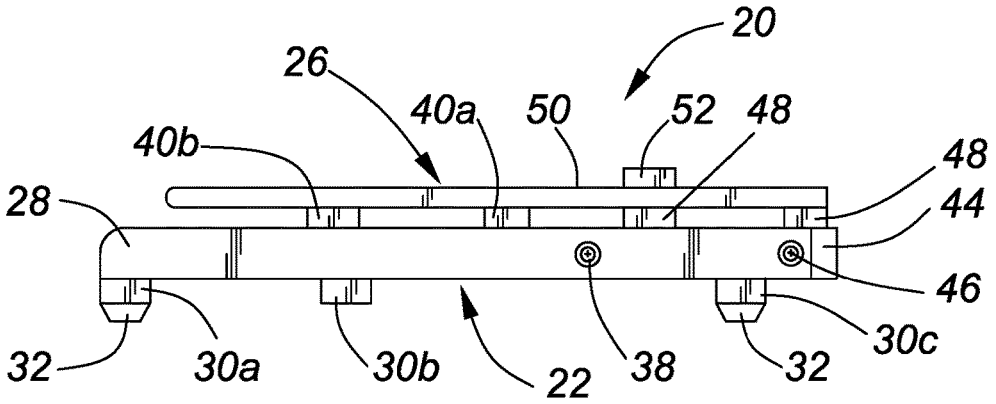
FIG. 9 is a side elevational view of the dish drying rack in the folded condition.

FIG. 9 is a side elevational view of the dish drying rack 20 in the folded condition. The upper upright side members 44 rest on the base cross member 30*c* and upper ends of the upright posts 50 rest against a rear side of the back cross members 40*a*, 40*b*.

Figure 10:
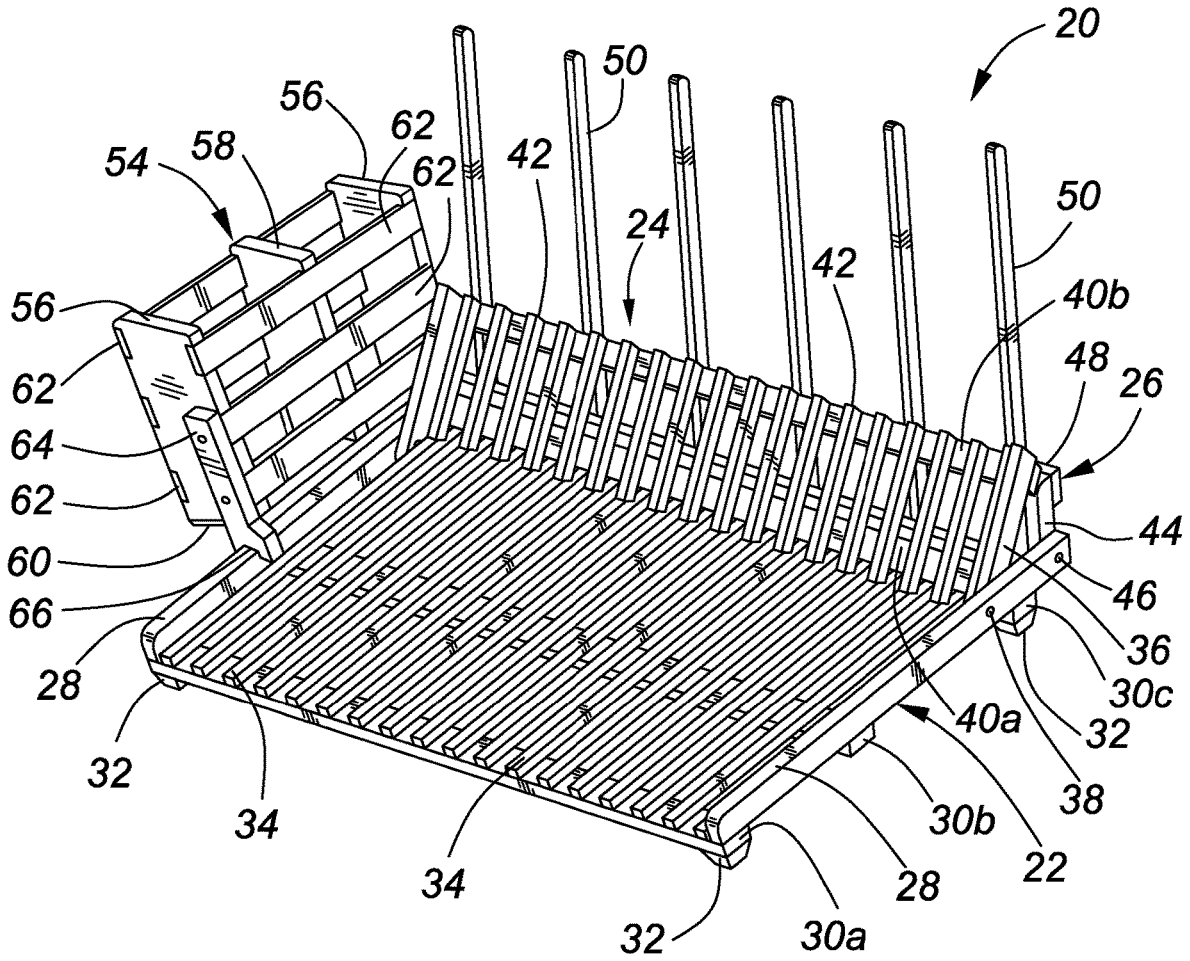
FIG. 10 is a perspective view of the dish drying rack in an unfolded condition with a removable utensil tray in accordance with the invention on a left side thereof.

FIG. 10 is a perspective view of the dish drying rack 20 in an unfolded condition with a removable utensil tray 54 in accordance with the invention supported on the base side member 28 on a left side thereof. The removable utensil tray 54 has two utensil tray side panels 56 and a utensil tray center panel 58. Utensil tray slats 62 are affixed to the respective edges of the utensil tray side panels 56 and the utensil tray center panel 58. In one embodiment there are three utensil tray slats 62 on each side of the utensil tray 54, and each utensil tray slat 62 is received in a respective rabbet in the utensil tray side panels 56 and the utensil tray center panel 58. A utensil tray bottom panel 60 is affixed to bottom ends of the base side panels 56 and the utensil tray center panel 58. In one embodiment, the bottom ends of the base side panels 56 and the utensil tray center panel 58 are cut at an angle of about 15° (see FIG. 17A) to facilitate the drainage of water from the utensil tray bottom panel 60. Affixed to one edge of each outer side of each utensil tray side panel 56 is a utensil tray support arm 64. A lower end of each utensil tray support arm 64 has a utensil tray support arm notch 66 that fits over one of the base side members 28 to securely support the utensil tray 54 on either side of the dish drying rack 20.

Figure 11:
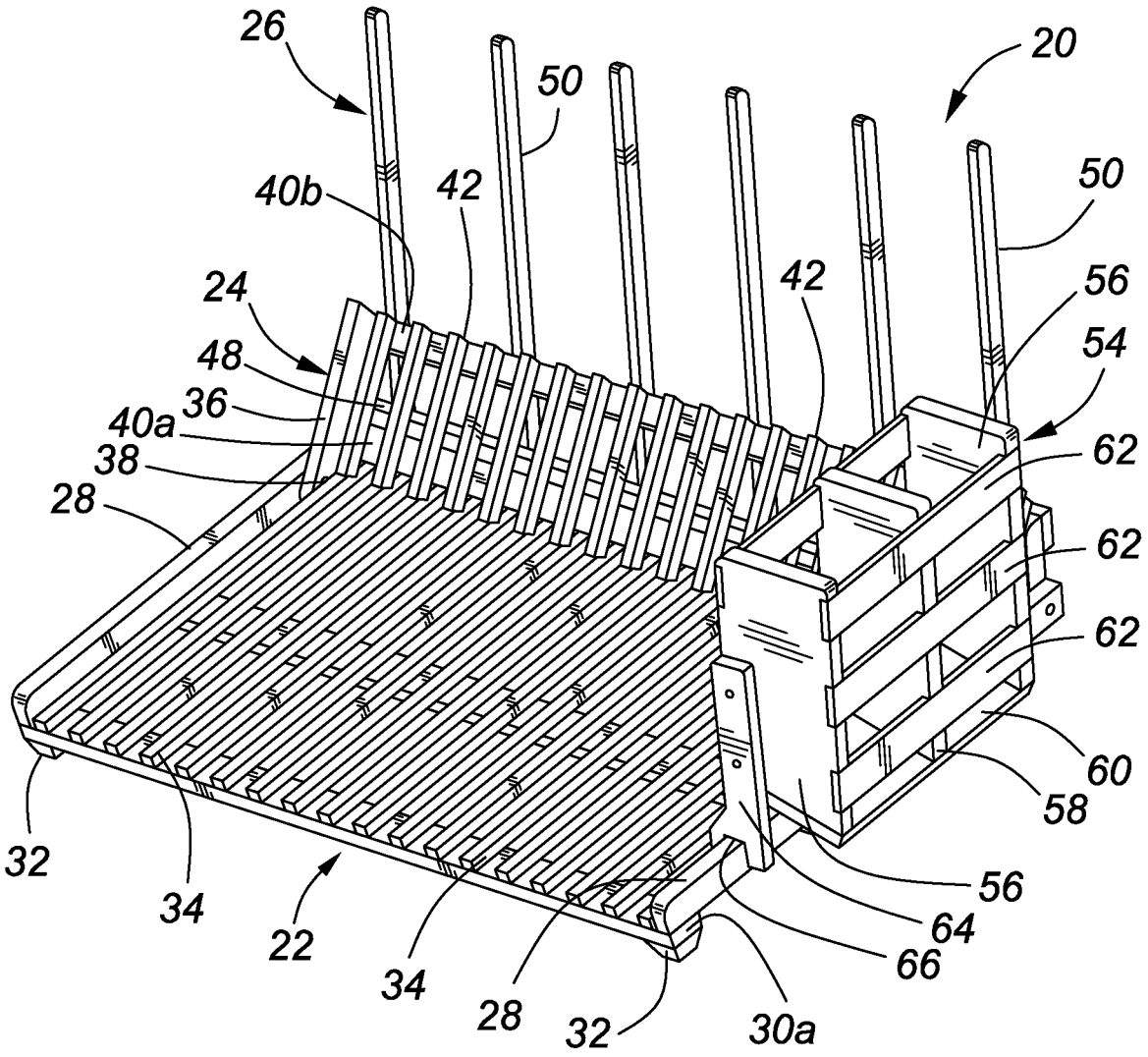
FIG. 11 is a perspective view of the dish drying rack in an unfolded condition with the utensil tray of a right side thereof.

FIG. 11 is a perspective view of the dish drying rack 20 in an unfolded condition with the removable utensil tray 54 of a right side thereof.

Figure 12:
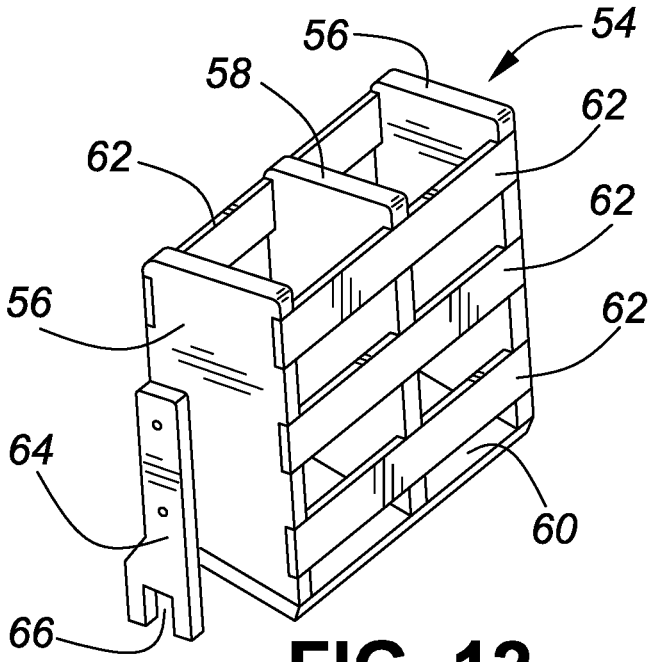
FIG. 12 is a perspective view of the utensil tray.

FIG. 12 is a perspective view of the utensil tray 54.

Figure 13:
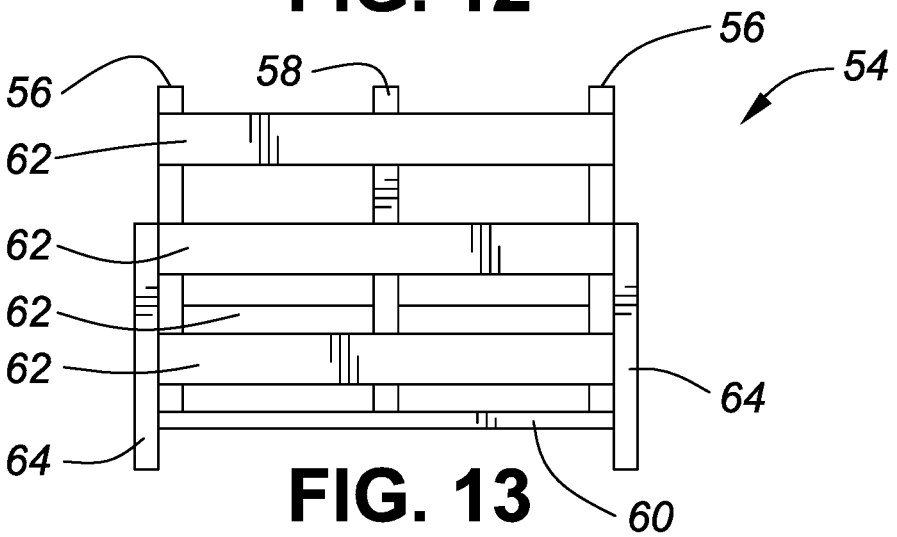
FIG. 13 is a front elevational view of the utensil tray shown in FIG. 12.

FIG. 13 is a front elevational view of the utensil tray 54 shown in FIG. 12.

Figure 14:
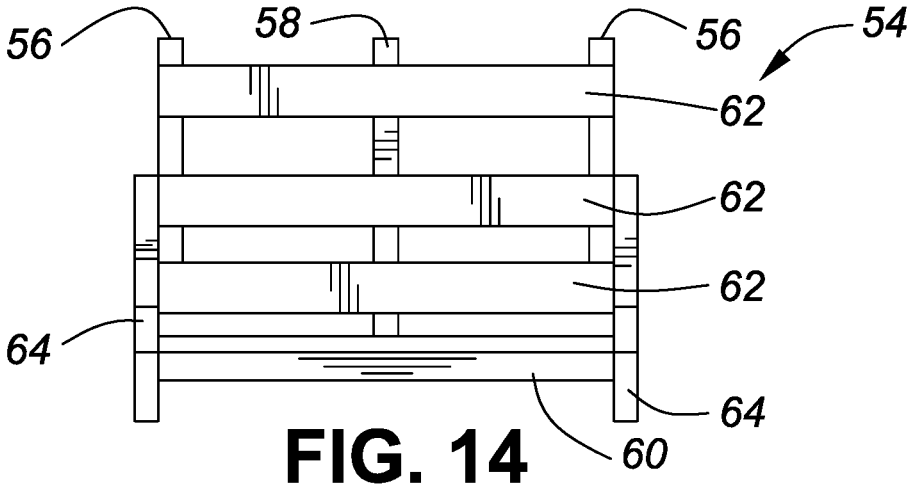
FIG. 14 is a rear elevational view of the utensil tray shown in FIG. 12.

FIG. 14 is a rear elevational view of the utensil tray 54 shown in FIG. 12.

Figure 15:
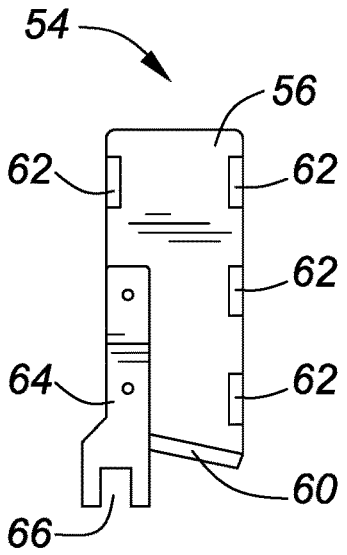
FIG. 15 is a left side elevational view of the utensil tray shown in FIG. 12.

FIG. 15 is a left side elevational view of the utensil tray 54 shown in FIG. 12.

Figure 16:
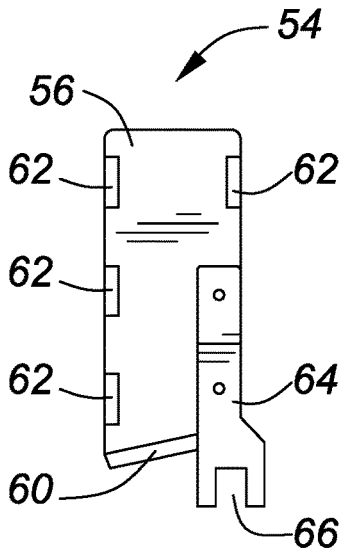
FIG. 16 is a right side elevational view of the utensil tray shown in FIG. 12.

FIG. 16 is a right side elevational view of the utensil tray 54 shown in FIG. 12.

Figure 17A:
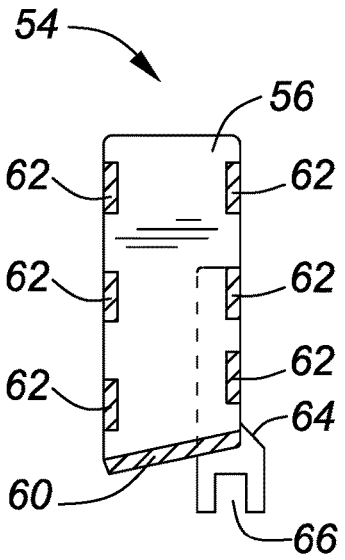
FIG. 17A is a cross-sectional view of the utensil tray taken along lines 17A-17A of FIG. 17.
Figure 17:
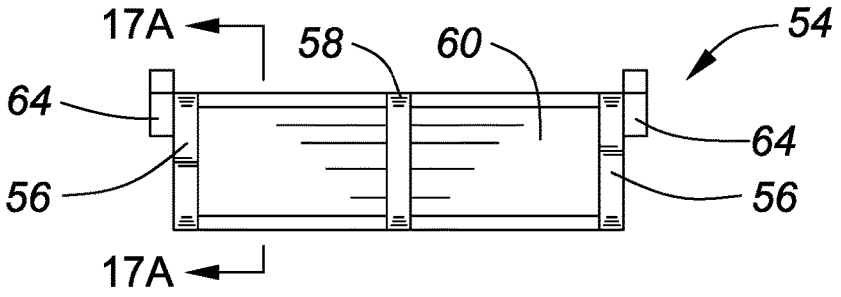
FIG. 17 is a top plan view of the utensil tray shown in FIG. 12.

FIG. 17 is a top plan view of the utensil tray 54 shown in FIG. 12.

FIG. 17A is a cross-sectional view of the utensil tray 54 taken along lines 17A-17A of FIG. 17.

Figure 18:
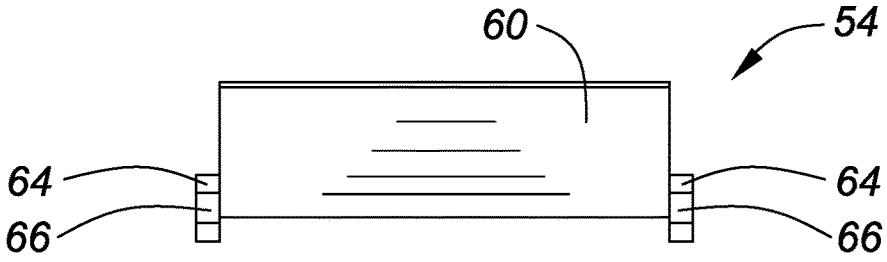
FIG. 18 is a bottom plan view of the utensil tray shown in FIG. 12.

FIG. 18 is a bottom plan view of the utensil tray 54 shown in FIG. 12.

FIG. 19 is a perspective view of the dish drying rack 20 with the utensil tray 54 in an exemplary use condition with the utensil tray 54 on a right side of the dish drying rack 20. Dishes are supported on edge between the base slats 34 and the back slats 42. Plates are further supported by base cross member 30*b* and back cross members 40*a* and 40*b*. Smaller dessert plates for example may only bear weight on base cross member 30*b* and back cross member 40*a*. While dinner plates may bear weight on base cross member 30*b* and both back cross members 40*a* and 40*b*. Large serving plates may only bear weight on base cross member 30*b* and back cross member 40*b*. The spatial relationship between base cross member 30*b* and back cross members 40*a* and 40*b* and the angle of the inclined rack back section 24 with respect to the rack base section 22 permit dish drying rack 20 to support plates of practically any useful diameter. Additionally, the space between each pair of adjacent base slats 34 and corresponding back slats 42 permit dish drying rack 20 to support plates with a variety of cross sectional profiles.

Glasses, cups, plastic bags, bottles, mugs and similar items may be supported in an inverted condition on the upright posts 50. Bowls and other items not readily supported on edge may be laid upside down on the base slats 34. Cutlery and utensils are supported in the utensil tray 54, which rapidly drains away rinse water. Air flows freely around and through all parts of the dish drying rack 20 and the utensil tray 54 to promote rapid air drying of anything supported thereon. When not in use, the utensil tray 54 can be lifted off the rack base section 22 and the dish drying rack 20 can be folded flat for space-efficient storage by pivoting the rack back section 24 and the rack upright section 26 forward as described above.

The embodiment of the invention shown and described is exemplary only. The scope of the invention is therefore intended to be limited only by the scope of the claims.

I claim:

1. A foldable dish drying rack comprising:

a substantially rectangular rack base section having base side members and a plurality of base slats;

a substantially rectangular rack back section having back side members pivotally connected to the base side members, the rack back section having a plurality of back slats that are respectively aligned with the respective base slats, the rack back section being pivotable from a folded condition in which the rack back section lies flat on the rack base section to an unfolded condition; and a substantially rectangular rack upright section having upright side members pivotally connected to the base side members behind the back side members, the rack upright section being pivotable from a folded condition in which the rack upright section lies flat on the rack base section and the rack back section to the unfolded condition in which the rack upright section supports a top of the rack back section, the rack upright section having a plurality of spaced-apart upright posts that extend above a top of the rack back section in the unfolded condition.

2. The foldable dish rack as claimed in claim 1 wherein the rack base section comprises:

the base side members, which are of equal length; and three base cross members having opposed ends affixed in spaced-apart relation to a bottom edge of the respective base side members, the base slats being affixed to a top surface of the respective base cross members so that front ends of the base slats are flush with a front edge of a front one of the base cross members.

3. The foldable dish rack as claimed in claim 2 wherein the front base cross member is flush with front ends of the respective base side members, a rear one of the base cross members is spaced forward of a rear end of the respective base side members, and a middle base cross member is nearer the front base cross member than the rear base cross member.

4. The foldable dish rack as claimed in claim 1 wherein the rack back section comprises:

the two back side members, which are of equal length;

two back cross members having opposed ends affixed in spaced-apart relation to a rear edge of the respective back side members, the back slats being affixed to a top surface of the respective back cross members so that top ends of the back slats are flush with a top edge of a top one of the back cross members.

5. The foldable dish drying rack as claimed in claim 1 wherein the rack upright section comprises two upright cross members affixed to a rear surface of the upright side members, and the upright posts are affixed to a rear surface of the respective upright cross members in an equally spaced-apart relationship.

6. The foldable dish drying rack as claimed in claim 5 further comprising an upright post reinforcement member affixed to the respective upright posts in alignment with an upper one of the upright cross members.

7. The foldable dish drying rack as claimed in claim 2 further comprising a utensil tray connectable to a one of the base side members of the rack base section, the utensil tray having utensil tray side panels, a utensil tray center panel, a utensil tray bottom panel and utensil tray slats connected to the utensil tray side panels and the utensil tray center panel, and further having utensil tray support arms connected to outer side edges of the respective utensil tray side panels, the utensil tray support arms having utensil tray support arm notches that accept a top edge of one of the base side members to support the utensil tray in an upright condition.

8. The foldable dish drying rack as claimed in claim 2 further comprising a base foot affixed to opposed ends of the front one and a rear one of the base cross members.

9. A foldable dish drying rack comprising:

a rack base section having two parallel base side members affixed to at least two base cross members and a plurality of identical base slats equally spaced-apart between the base side members and affixed to the base cross members;

a rack back section having two parallel back side members having bottom ends that are respectively pivotally connected to one of the base side members, the back side members being affixed to back cross members, and a plurality of identical back slats affixed to the back cross members between the back side members and parallel therewith, each back slat being aligned with a corresponding base slat; and a rack upright section having two parallel upright side members with bottom ends that are respectively pivotally connected to the base side members behind the back side members, the upright side members being affixed to upright cross members, and a plurality of upright posts affixed to a rear side of the upright cross members between the base side members and in parallel therewith.

10. The foldable dish rack as claimed in claim 9 wherein the rack base section comprises three base cross members having opposed ends affixed in spaced-apart relation to a bottom edge of the respective base side members, the base slats being affixed to a top surface of the respective base cross members so that front ends of the base slats are flush with a front edge of a front one of the base cross members.

11. The foldable dish rack as claimed in claim 10 wherein the front base cross member is flush with front ends of the respective base side members, a rear one of the base cross members is spaced forward of a rear end of the respective base side members, and a middle base cross member is nearer the front base cross member than the rear base cross member.

12. The foldable dish rack as claimed in claim 9 wherein the rack back section comprises two back cross members having opposed ends affixed in spaced-apart relation to a rear edge of the respective back side members, the back slats being affixed to a top surface of the respective back cross members so that top ends of the back slats are flush with a top edge of a top one of the back cross members.

13. The foldable dish drying rack as claimed in claim 9 wherein the rack upright section comprises two upright cross members affixed to a rear surface of the upright side members, and the upright posts are affixed to a rear surface of the respective upright cross members in an equally spaced-apart relationship.

14. The foldable dish drying rack as claimed in claim 13 further comprising an upright post reinforcement member affixed to the respective upright posts in alignment with an upper one of the upright cross members.

15. The foldable dish drying rack as claimed in claim 9 further comprising a utensil tray connectable to a side of the rack base section, the utensil tray having utensil tray side panels, a utensil tray center panel, a utensil tray bottom panel and utensil tray slats connected to the utensil tray side panels and the utensil tray center panel, and further having utensil tray support arms connected to outer side edges of the respective utensil tray side panels, the utensil tray support arms having utensil tray support arm notches that accept a top edge of one of the base side members to support the utensil tray in an upright condition.

16. The foldable dish drying rack as claimed in claim 15 wherein the utensil tray slats are respectively received in rabbets cut in side edges of the utensil tray side panels and the utensil tray center panel.

17. The foldable dish drying rack as claimed in claim 15 wherein the utensil tray side panels and the utensil tray center panel have bottom ends cut at an angle so the utensil tray bottom panel rapidly drains away water.

18. The foldable dish drying rack as claimed in claim 9 further comprising a base foot affixed to opposed ends of a base cross member at a front of the base section and a base cross member at a rear of the base section.

19. A foldable dish drying rack comprising:

a rack base section having two parallel base side members affixed to a top of opposed ends of three base cross members and a plurality of identical base slats equally spaced-apart between the base side members and affixed to each of the base cross members;

a rack back section having two parallel back side members having bottom ends that are respectively pivotally connected to one of the base side members, the back side members being affixed to opposed ends of two back cross members, and a plurality of identical back slats affixed to each of the back cross members between the back side members and parallel therewith, each back slat being aligned with a corresponding base slat;

a rack upright section having two parallel upright side members with bottom ends that are respectively pivotally connected to the base side members behind the back side members, the upright side members being affixed to a front side of opposed ends of two upright cross members, and a plurality of upright posts affixed to a rear side of the upright cross members between the base side members and in parallel therewith; and a utensil tray connectable to one of the base side members of the rack base section, the utensil tray having utensil tray side panels, a utensil tray center panel, a utensil tray bottom panel and utensil tray slats connected to the utensil tray side panels and the utensil tray center panel, and further having utensil tray support arms connected to outer side edges of the respective utensil tray side panels, the utensil tray support arms having utensil tray support arm notches that accept a top edge of one of the base side members to support the utensil tray in an upright condition.

20. The foldable dish drying rack as claimed in claim 19 wherein the utensil tray side panels and the utensil tray center panel have bottom ends cut at an angle so the utensil tray bottom panel rapidly drains away water.

* * * * *